US005184008A

United States Patent [19]

Saito et al.

[11] Patent Number: 5,184,008

[45] Date of Patent: Feb. 2, 1993

[54] X-RAY IMAGING TUBE WITH SPECIFIC POSITIONAL AND SIZE RELATIONSHIP OF ELEMENTS

[75] Inventors: Keiichi Saito; Shigeharu Kawamura, both of Ootawara; Syozo Sato, Sagamihara; Kiyohito Kawasumi, Kofu, all of Japan

[73] Assignee: Kabushiki Kaisha Toshiba, Kawasaki, Japan

[21] Appl. No.: 772,911

[22] Filed: Oct. 10, 1991

[30] Foreign Application Priority Data

Oct. 12, 1990 [JP] Japan ..... 2-272215

[51] Int. Cl.[5] ..... H01J 31/50

[52] U.S. Cl. ..... 250/214 VT; 313/523

[58] Field of Search ..... 250/213 R, 213 VT; 313/523, 537

[56] References Cited

U.S. PATENT DOCUMENTS 3,801,849 4/1974 Edgecumbe .
4,585,935 4/1986 Butterwick ..... 250/213 VT

FOREIGN PATENT DOCUMENTS .

1468746 1/1967 France .
48-19503 6/1973 Japan .
54-116173 9/1979 Japan .
1026843 4/1966 United Kingdom .

*Primary Examiner*—David C. Nelms
*Attorney, Agent, or Firm*—Cushman, Darby & Cushman

[57] ABSTRACT

An X-ray imaging tube comprising an vacuum envelope, and input screen located in the input end of the envelope, an output screen located in the output end of the envelope, an anode located in the output end of the envelope, and a plurality of beam-converging electrodes located in the envelope and arranged along the inner surface of the envelope. The tube has an magnification of used input field size of 2.3 or more. The components of the tube have such positions and sizes, thus satisfying the following relations:

$$3.5 \leqq G3_D/A_D \leqq 5.0$$

$$-3.65 \times MAG + 1.00 \leqq G3_L/L \leqq -3.65 \times MAG + 1.05$$

where L is the distance between the input and output screens, $A_D$ is the inside diameter of the anode or one of the beam-converging electrodes set at the same potential as the anode, which is closer to the input screen than any other beam-converging electrodes set at the same potential as the anode, $G3_D$ is the inside diameter of one of beam-converging electrodes set at potential of at least 2 KV, which is closer to the input screen than any other electrode set at potential of at least 2 KV, $G3_L$ is the distance between the input screen and the electrode set at least 2 KV and located closer to the input screen than any other electrode set at least 2 KV, and MAG is the image-reducing ratio of the X-ray imaging tube.

3 Claims, 3 Drawing Sheets

X-RAY IMAGING TUBE WITH SPECIFIC POSITIONAL AND SIZE RELATIONSHIP OF ELEMENTS

BACKGROUND OF THE INVENTION

1. Field of the Invention

The present invention relates to an X-ray imaging tube, and more particularly to the electrodes incorporated in the envelope of the X-ray imaging tube.

2. Description of the Related Art

An X-ray imaging tube is a device which comprises an input screen, an electrostatic electron lens system, and an output screen. The input screen has a phosphor layer and a photoelectric layer. The output screen has a phosphor layer. In operation, X-rays are applied to the input screen. The phosphor layer of the input screen converts X-rays into visible light. The photoelectric layer, which is made of alkali-antimony, converts the visible light into electrons. The electron lens system accelerates electrons and converges electron beams. The electron beams, thus converged, are applied to the phosphor layer of the output screen, which emits rays corresponding the X-rays. Hence, the X-rays applied to the input screen are observed in real time.

FIG. 1 schematically shows a high performance X-ray imaging tube in which the size of the view field can be changed. As is evident from FIG. 1, this X-ray imaging tube comprises a vacuum envelope 1. The envelope 1 comprises a metal cylinder 1*a*, a glass cylinder 1*b*, and an input window 2 made of aluminum, aluminum alloy, titanium, titanium alloy, or the like. The X-ray imaging tube further comprises an input screen 3, beam-conversing electrodes 4*a*, 4*b* and 4*c*, an anode 5, and an output screen 6—all located within the vacuum envelope 1. The input screen 3 faces the input window 2 and is curved along the input window 2. The anode 5 and the output screen 6 are located in the output end of the envelope 1.

The electrodes 4*a*, 4*b* and 4*c* are hollow cylinders for forming an electrostatic electron lens. They are coaxial with the vacuum envelope 1, spaced apart from one another in the axial direction of the envelope 1, and designed to form an X-ray image which has a uniform resolution regardless of the size of the input view field. In operation, a voltage ranging from 0 V to 25 KV is applied between the anode 5 and the photoelectric layer of the input screen 3 and the anode. In this condition, voltages are applied to the electrodes 4*a*, 4*b* and 4*c*, whereby these electrodes form an electron lens. The voltages applied to the electrodes 4*a*, 4*b* and 4*c* are changed, thus reducing the size of the view field of the X-ray imaging tube, for example, form 9 inches to 4.5 inches, from 12 inches to 6 inches, or from 14 inches 7 inches. In other words, the X-ray imaging tube shown in FIG. 1 has an image magnification of about 2.

As is shown in FIG. 2, the beam-converging electrode 4*c* is set at potential of about 2 KV when the magnification of used input field size is 1. This potential increases exponentially with the magnification of used input field size. As can be understood from the curve shown in FIG. 2, to increase the magnification to 2.3 or more, it is necessary to set the electrode 4*c* at potential of 20 KV or more. When the electrode 4*c* is set at 20 KV, however, the withstand voltage between the beam-converging electrodes 4*b* and 4*c* greatly decrease since the electrode 4*b* is set at potential of only hundreds of volts to 1.5 KV. Due to the insufficient withstand voltage, an undesirable phenomenon, such as electrical discharge or electrical leak, may occur, much impairing the ability and/or reliability of the X-ray imaging tube.

For the electrostatic electron lens system of the conventional X-ray imaging tube, it is practically impossible to provide an magnification of used input field size of 2.3 or more. To attain an magnification of used input field size of at least 2.3, at no expense of the ability or reliability, the X-ray imaging tube should be redesigned drastically.

For example, the electrode 4*b* can be replaced by two or more electrodes $4c_1$, $4c_2$, . . . $4c_N$ ($N \geqq$) as is shown in FIG. 3. In this case, these electrodes $4c_1$, $4c_2$, . . . $4c_N$ can be set at the lowest potential, the second lowest potential, . . . and the highest potential, respectively, so that the potential difference between the beam-converging electrode 4*b* and the electrode $4c_1$ located closer to the electrode 4*b* than the electrodes $4c_2$, $2c_3$, . . . $4c_N$.

The use of more beam-converging electrodes, however, makes it more difficult to assemble the X-ray imaging tube. Moreover, the X-ray imaging tube needs to have a more complex power-supply device for applying different voltages to the beam-converging electrodes. Hence, the X-ray imaging tube cannot be manufactured at sufficiently high productivity or sufficiently low cost.

SUMMARY OF THE INVENTION

The object of the present invention is to provide an X-ray imaging tube which can be manufactured at low cost with high productivity and which has good withstand-voltage characteristic even when its magnification of used input field size is set at 2.3 or more. According to the invention, there is provided an X-ray imaging tube which comprises an vacuum envelope, an input screen located in the input end of the envelope, an output screen located in the output end of the envelope, an anode located in the output end of the envelope, and a plurality of beam-converging electrodes located in the envelope and arranged along the inner surface of the envelope.

The components of the X-ray imaging tube have specific positional relationship and particular sizes, thus satisfying the following relations:

$$3.5 \leqq G3_D/A_D \leqq 5.0$$

$$-3.65 \times MAG + 1.00 \leqq G3_L/L \leqq -3.65 \times MAG + 1.05$$

where L is the distance between the input and output screens, $A_D$ is the inside diameter of the anode or that one of the beam-converging electrodes set at the same potential as the anode, which is located closer to the input screen than any other beam-converging electrodes set at the same potential as the anode, $G3_D$ is the inside diameter of that one of beam-converging electrodes set at potential of at least 2 KV, which is located closer to the input screen than any other electrode set at potential of at least 2 KV, $G3_L$ is the distance between the input screen and the electrode set at at least 2 KV and located closer to the input screen than any other electrode set at at least 2 KV, and MAG is the image-reducing ratio, i.e., (output-image diameter)/(maximum input effective diameter) of the X-ray imaging tube.

Since the sizes of the components and the positional relationship thereof, which satisfy the above relations, the X-ray imaging tube according to the invention can have an magnification of used input field size of 2.3 or more. Further, since the X-ray imaging tube has but a minimum number of beam-converging electrodes, it is simple in structure and requires no complex power-supply devices. It can therefore be assembled with sufficiently high productivity and can be manufactured at sufficiently low cost.

Detailed Description of the Preferred Embodiments

Figure 4:
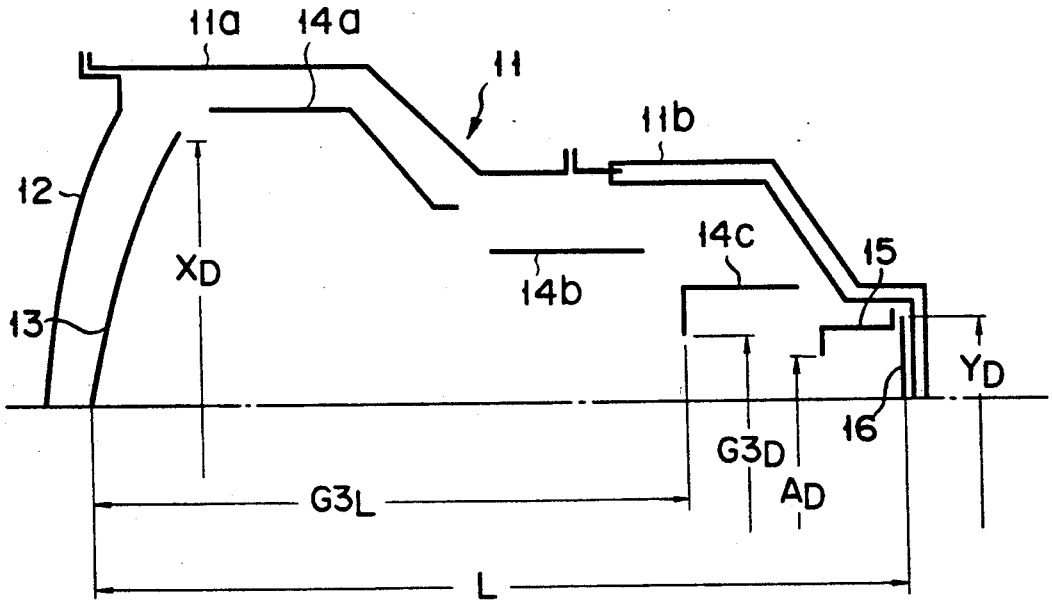
FIG. 4 is a sectional view schematically showing an X-ray imaging tube according to the invention.

FIG. 4 shows an X-ray imaging tube according to the present invention. The X-ray imaging tube has a vacuum envelope 11. The envelope 11 comprises a cylindrical metal section 11*a*, a funnel-shaped glass section 11*b* connected at one end to the metal section 11*a* and closed at the other end, and an input window 12 made of aluminum and closing the input end of the metal section 11*a*.

The X-ray imaging tube further comprises an input screen 13, an anode 15, and an output screen 16—all located within the vacuum envelope 11. The input screen 13 is arranged, spaced apart from the input window 12 and curved along the window 12. Both the anode 15 and the output screen 16 are placed in the output end of the envelope 11. The input screen 13 is formed of, at least, a phosphor layer and a photoelectric layer. The output screen 16 is formed of, at least, a phosphor layer.

Three beam-converging electrodes 14*a*, 14*b*, and 14*c* are provided in the vacuum envelope 11. They are hollow cylinders arranged coaxial with the envelope 11, spaced part from one another in the axial direction of the envelope 11. These electrodes 14*a*, 14*b*, and 14*c* form an electrostatic electron lens system. In operation, the input screen 13, the anode 15, the electrode 14*a*, the electrode 14*b*, and electrode 14*c* are set at potentials of 0 V, 25 KV, 100 to 200 V, 500 to 1.5 KV, and 2 KV to 17 KV, respectively.

The components provided within the vacuum envelope 11 have such specific positional relationship and such particular sizes, that the following relations are satisfied:

$$3.5 \leqq G3_D/A_D \leqq 5.0$$

$$-3.65 \times MAG + 1.00 \leqq G3_L/L \leqq -3.65 \times MAG + 1.05$$

where L is the distance between the input screen 13 and the output screen 16, $A_D$ is the inside diameter of the anode 15, $G3_D$ is the inside diameter of the beam-converging electrode 14*c* having potential of at least 2 KV, $G3_L$ is the distance between the input screen and the beam-converging electrode 14*c*, and MAG is the image-reducing ratio, i.e., (output-image diameter)/(maximum input effective diameter).

Figure 5:
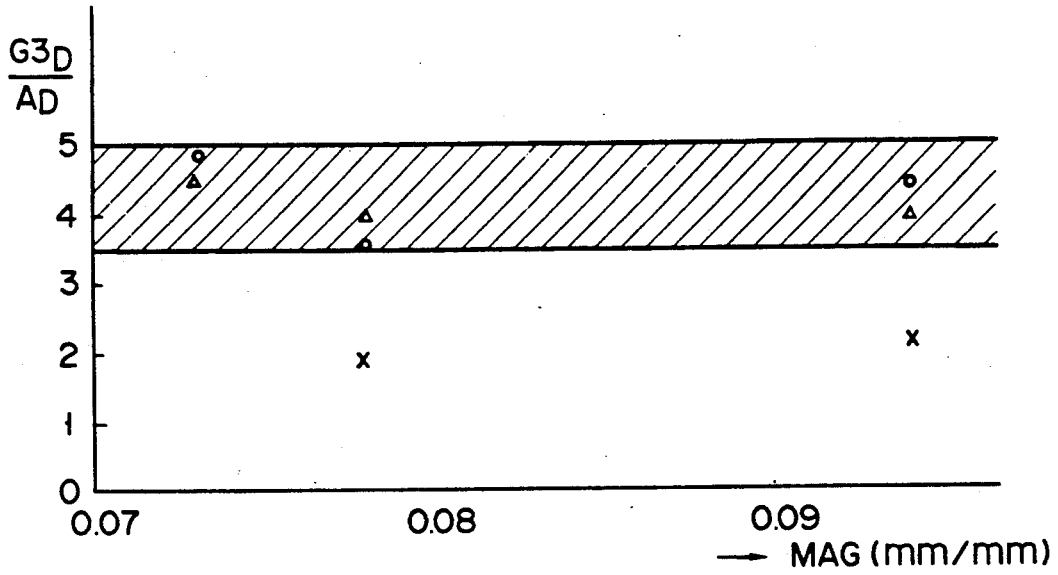
FIG. 5 is a diagram illustrating the characteristic of the X-ray imaging tube shown in FIG. 4, more precisely, the relationship between the image-reducing ratio and the ratio of the inside diameter of the last-stage beam-converging electrode to the inside diameter of the anode; an FIG. 6 is a diagram showing the relationship between the image-reducing ratio of the X-ray imaging tube shown in FIG. 4 and the ratio of the distance between the input screen and last-stage electrode thereof to the distance between the input and output screens thereof.

It will now be explained why the components should be located such positions and have such sizes as to satisfy the relation of $3.5 \leqq G3_D/A_D \leqq 5.0$, with reference to FIG. 5. FIG. 5 is a graph showing the relationship between the image-reducing ratio MAG and the ratio of the inside diameter $G3_D$ of the electrode 14*c* to the inside diameter $A_D$ of the anode 15, i.e., $G3_D/A_D$. As is evident from FIG. 5, as long as the ratio $G3_D/A_D$ remains in the shaded region in FIG. 5, the input effective diameter can be reduced from 12 inches to 4.5 inches, or from 16 inches to 6 inches, and the resultant X-ray image can have a uniform resolution regardless of the size of the input view field, when the anode 15 and the electrode 14*c* are set at 30 KV and 17 KV or less, respectively.

In FIG. 5, marks o, Δ, and × represents the samples which have been tested to acquire the diagram of FIG. 5. The o-marked samples and the Δ-marked samples form X-ray images having a uniform resolution. With the x-marked samples cannot form X-ray images of a uniform resolution. This is because the electrode 14*c* needs to be set at 20 KV or more, the magnification of used input field size cannot be increased to 2.3 or more, or the image resolution is much degraded at the edge portion of the view field. The Δ-marked samples, wherein the ratio $G3_D/A_D$ ranges from 4.1 to 4.7, are more preferable than the o-marked samples. Hence, in the present invention, the components in the envelope 11 should be arranged at such positions and have such size as to satisfy the relation of $3.5 \leqq G3_D/A_D \leqq 5.0$.

It will now be explained why the components should be located such positions and have such sizes as to satisfy the relation of $-3.65 \times MAG + 1.00$ $G3_L/L \leqq -3.65 \times MAG + 1.05$, with reference to FIG. 6.

Figure 6:
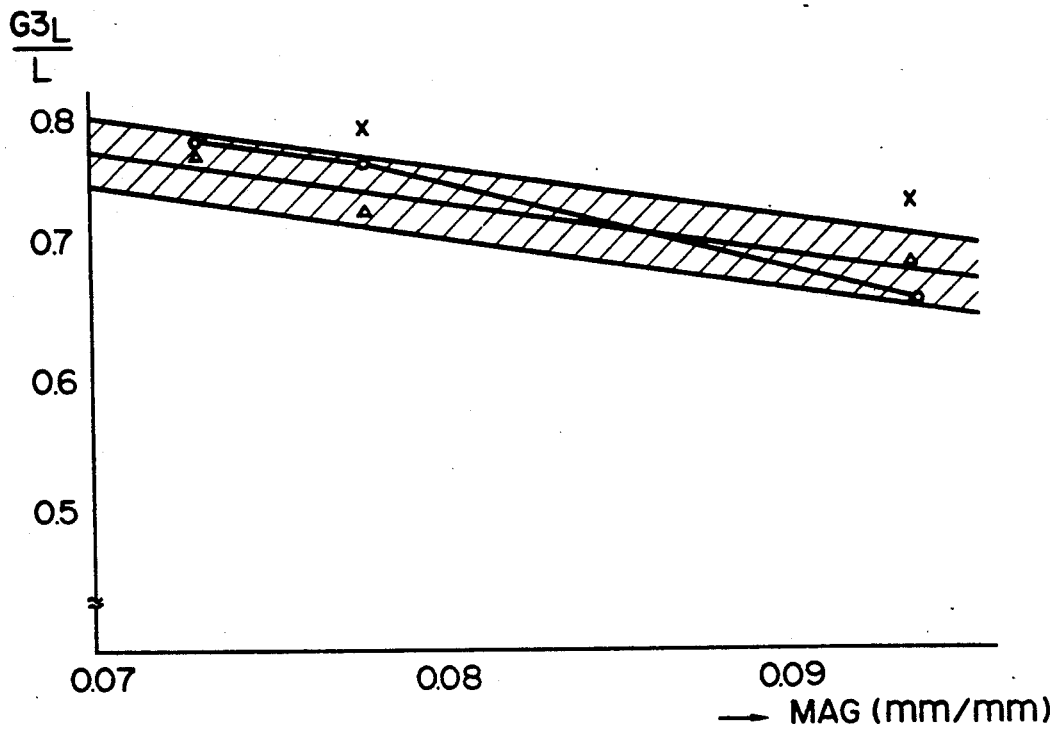

FIG. 6 illustrates the relationship between the image-reducing ratio MAG (i.e., output-image diameter $Y_D$/-maximum input effective diameter $X_D$) and the ratio $A_D$ of the distance $G3_D$ between the input screen 13 and the electrode 14*c* to the distance $A_D$ between the input screen 13 and the output screen 16.

As is evident from FIG. 6, the slope on which the best samples, i.e., the Δ-marked ones, plotted has an approximate linear function of −3.65. From this linear function, the ratio $G3_L/L$ of $-3.65 \times MAG + 1.05$ can be obtained for an X-ray imaging tube whose input view field has diameter of 12 inches, and the ratio $G3_L/L$ of $-3.65 \times MAG + 1.00$ can be obtained for an X-ray imaging tube whose input view field has diameter of 16 inches. This is why the components should be located such positions and have such sizes as to satisfy the relation of $-3.65 \times MAG + 1.00 \leqq G3_L/L \leqq -3.65 \times MAG + 1.05$.

As can be understood from FIG. 6, as long as the ratio $G3_L/L$ remains in the shaded region in FIG. 6, the input effective diameter can be reduced from 12 inches to 4.5 inches, or from 16 inches to 6 inches, and the resultant X-ray image can have a uniform resolution regardless of the size of the input view field, when the anode 15 and the electrode 14*c* are set at 30 KV and 17 KV or less, respectively.

In both FIG. 5 and FIG. 6, the parameters of the conventional X-ray imaging tubes, whose magnification of used input field size is approximately 2, are indicated at x marks. Obviously, these conventional X-ray imaging tubes fall outside the scope of the present invention.

The embodiment, shown in FIG. 4 and described above, has only three beam-converging electrodes 14*a*, 14*b*, and 14*c*. Nonetheless, according to the invention, four or more beam-converging electrodes can be incorporated in the vacuum envelope 11. In this Case, too, these electrodes, the input screen 13, the anode 15, and the output screen 16—all located within the envelope 11, have specific positional relationship and particular sizes, thus satisfying the following relations:

$$3.5 \leqq G3_D/A_D \leqq 5\ 5.0$$

$$-3.65 \times MAG + 1.00 \leqq G3_L/L \leqq -3.65 \times MAG + 1.05$$

where L is the distance between the input screen 13 and the output screen 16, $A_D$ is the inside diameter of the anode 15 or that one of the beam-converging electrodes set at the same potential as the anode 15, which is located closer to the input screen 13 than any other beam-converging electrodes set at the same potential as the anode 15, $G3_D$ is the inside diameter of that one of beam-converging electrodes set at potential of at least 2 KV, which is located closer to the input screen 13 than any other electrode set at potential of at least 2 KV, $G3_L$ is the distance between the input screen 13 and the electrode set at at least 2 KV and located closer to the input screen 13 than any other electrode set at at least 2 KV, and MAG is the image-reducing ratio, i.e., (output-image diameter)/(maximum input effective diameter) of the X-ray imaging tube.

Figure 1:
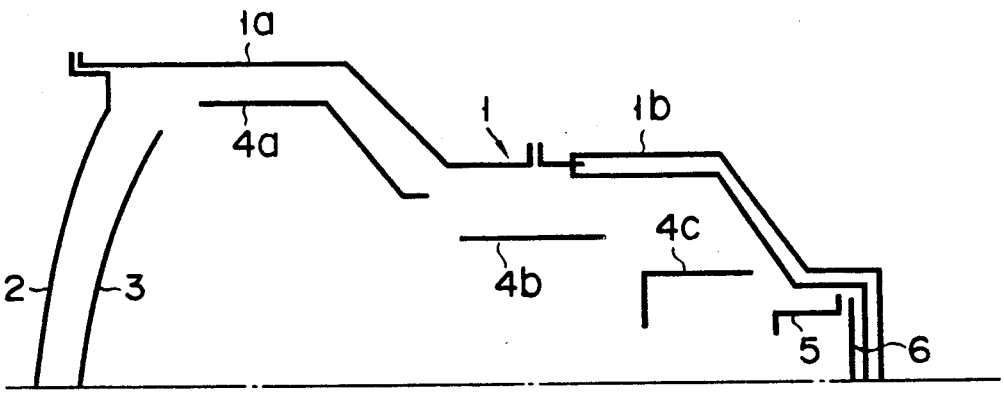
FIG. 1 PRIOR ART
FIG. 1 is a sectional view schematically showing a conventional X-ray imaging tube.
Figure 2:
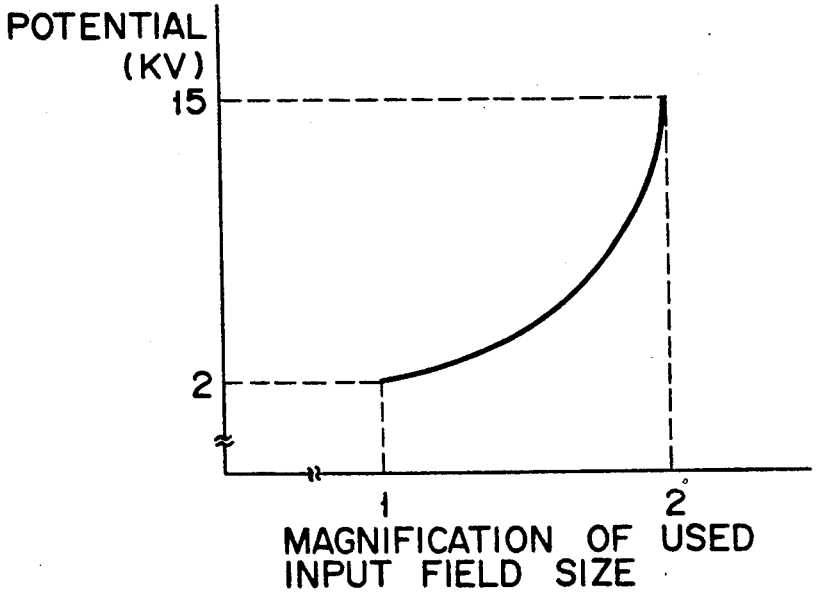
FIG. 2 PRIOR ART
FIG. 2 is a graph representing the relationship between the magnification of used input field size of the tube shown in FIG. 1 and the potential of the last-stage beam-converging electrode thereof.
Figure 3:
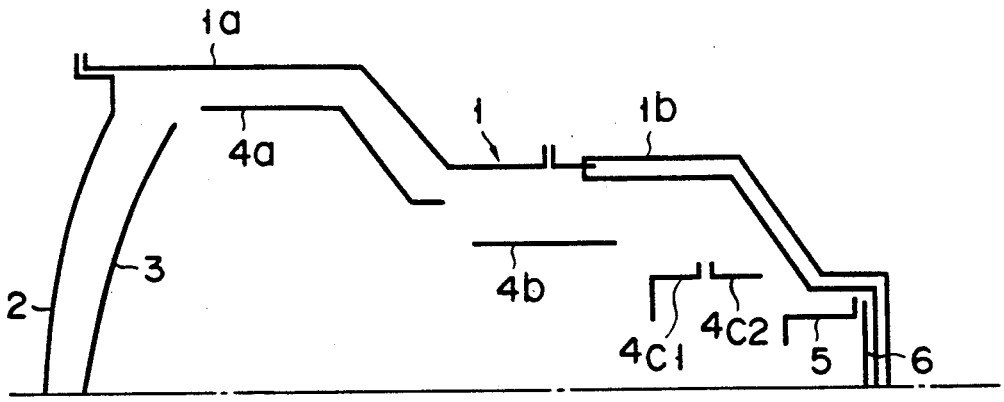
FIG. 3 PRIOR ART
FIG. 3 is a sectional view schematically showing another conventional X-ray imaging tube.

As has been described, the present invention can provide an X-ray imaging tube whose input effective-diameter magnification is 2.3 or more. Since any beam-conversing electrode used need not be split into two as in the conventional X-ray imaging tube shown in FIG. 3, the X-ray imaging tube of this invention is constituted by less components, and requires no such a complex power-supply device as is used to drive the conventional X-ray imaging tube. Therefore, the X-ray imaging tube according to the present invention can be manufactured with higher productivity and at lower cost.

If any electrostatic electron lens system that falls outside the present invention is to have an magnification of used input field size of 2.3 or more, its beam-converging electrode corresponding to the electrode 14*c* must be set at so high a potential as 20 KV or more, and its beam-converging electrode corresponding to the electrode 14*b* must be set at hundreds of volts to 1.5 KV. Obviously, the withstand voltage between these beam-converging electrodes would decreases so much that this electron lens system can not be put to practical use.

What is claimed is:

1. An X-ray imaging tube comprising:

a vacuum envelope, an input screen located in the input end of said envelope;

an output screen located in the output end of said vacuum envelope;

an anode located in the output end of said vacuum envelope; and a plurality of beam-converging electrodes located in said vacuum envelope and arranged along the inner surface of said vacuum envelope, wherein said components have specific positional relationship and particular sizes, thus satisfying the following relations:

$$3.5 \leqq G3_D/A_D \leqq 5.0$$

$$-3.65 \times MAG + 1.00 \leqq G3_L/L \leqq -3.65 \times MAG + 1.05$$

where L is the distance between said input and output screens, $A_D$ is the inside diameter of said anode or that one of said beam-converging electrodes set at the same potential as said anode, which is located closer to said input screen than any other beam-converging electrodes set at the same potential as said anode, $G3_D$ is the inside diameter of that one of beam-converging electrodes set at potential of at least 2 KV, which is located closer to said input screen than any other electrode set at potential of at least 2 KV, $G3_L$ is the distance between said input screen and the electrode set at at least 2 KV and located closer to said input screen than any other electrode set at at least 2 KV, and MAG is the image-reducing ratio, i.e., (output-image diameter)/(maximum input effective diameter) of the X-ray imaging tube.

2. The X-ray imaging tube according to claim 1, wherein said vacuum envelope comprises a hollow cylindrical metal section having an input end and an output end, a funnel-shaped glass section connected at one end to the output end of the metal section and closed at the other end, and an input window connected to the input end of the metal section.

3. The X-ray imaging tube according to claim 1, wherein said input screen comprises a phosphor layer and a photoelectric layer, and said output screen comprises a phosphor layer.

* * * * *